United States Patent [19]

Collins et al.

[11] Patent Number: 4,926,732

[45] Date of Patent: May 22, 1990

[54] VARIABLE CHORD-FORMING CAPOTASTO

[76] Inventors: William D. Collins, Eagle's Aerie Farm, Rustic Hills Rte. 4; Jeremiah Sundown, Rte. 4, both of Ashland City, Tenn. 37015

[21] Appl. No.: 367,485

[22] Filed: Jun. 16, 1989

[51] Int. Cl.[5] ..... G10D 3/04
[52] U.S. Cl. ..... 84/318
[58] Field of Search ..... 84/315–318

[56] References Cited

U.S. PATENT DOCUMENTS

| | | | |
|---|---|---|---|
| D. 281,508 | 11/1985 | McKinney, III | D17/120 |
| 3,446,108 | 5/1969 | Mitchell, Jr. | 84/317 |
| 3,680,427 | 8/1972 | Valentino | 84/456 |
| 3,776,088 | 12/1973 | Jones | 84/317 |
| 3,915,051 | 10/1975 | Kincaid | 84/317 |
| 4,030,400 | 6/1977 | Del Castillo | 84/317 |
| 4,183,279 | 1/1980 | Shabram | 84/318 |
| 4,324,165 | 4/1982 | Wilkerson | 84/318 |
| 4,331,059 | 5/1982 | Marabotto | 84/317 |
| 4,334,457 | 6/1982 | Spoonts | 84/318 |
| 4,583,440 | 4/1986 | Powell, Jr. | 84/318 |
| 4,671,156 | 6/1987 | Hathcock | 84/318 |
| 4,823,670 | 4/1989 | Gherman et al. | 84/318 |

FOREIGN PATENT DOCUMENTS

| | | | |
|---|---|---|---|
| 1316068 | 5/1973 | United Kingdom | 84/317 |
| 2188184 | 9/1987 | United Kingdom | 84/318 |

*Primary Examiner*—Lawrence R. Franklin

[57] ABSTRACT

An improved and more versatile, variable capotasto for multistringed instruments, such as guitars, banjos, mandolins and the like. This capotasto is attached to the neck of an instrument by a resilient strap, containing eyelets for adjustment expediently from fret to fret positions. Optionally, a spring loaded or thumb screw adjustable clamp can be made onto the capotasto in order to attach it to an instrument. The unit consists of a Mounting Block which contains 6 (for guitars) spring-tensioned Plungers with padded tips. The Mounting Block also supports a sub-system of 6 vertically installed Cam Levers, each of which respectively can cause any one of the 6 Plunger's tips to press upon an instrument's string behind a fret bar. Hence, this allows the musician to conveniently and quickly change the pitch of any or all strings with this capotasto. The 6 strings can be selectively changed to any combination of open or muted notes, as well as augmenting a multiplicity of open and bar chords. Many various and new chord colorations may be obtained, with enriching and innovative sounds, from this capotasto.

9 Claims, 3 Drawing Sheets

VARIABLE CHORD-FORMING CAPOTASTO

BACKGROUND OF THE INVENTION

A capotasto is a device that allows a player to temporarily raise the pitch of a stringed/fretted instrument (guitar, banjo, ukelele, etc.), by clamping the device between chosen random frets on the fingerboard of the instrument. This allows "open" chording, opposed to "sharps and flats" chording, giving the strummed chord a fuller presence and tone.

SUMMARY OF THE INVENTION

Prior and previous capotasto designs and applications have basically fulfilled the tasks aforesaid. However, this invention goes well beyond these basic functions.

Our CAPOTASTO consists of a Mounting Block which contains 6 (for guitars) spring tensioned plungers with padded tips. The Mounting Block also supports a sub-system of 6 vertically installed Cam Levers, each of which respectively can cause any one of the 6 plunger's tips to press upon an instrument's string behind a fret bar. Hence, this allows the musician to conveniently and quickly change the pitch of any or all strings with this CAPOTASTO. The 6 strings can be selectively changed to any combination of open or muted notes, as well as augmenting a multiplicity of open and bar chords.

Hence, this invention has individual string fretters, which can easily be adjusted for height, according to diameters of multiple strings on various instruments, allowing uniformity in tuning. In this manner, different fingerboards are also compensated for any curvatures. Many variations and new chord colorations may be obtained with enriching and innovative sounds from our CAPOTASTO.

DETAILED DESCRIPTION OF THE PREFERRED EMBODIMENT

Figure 1:
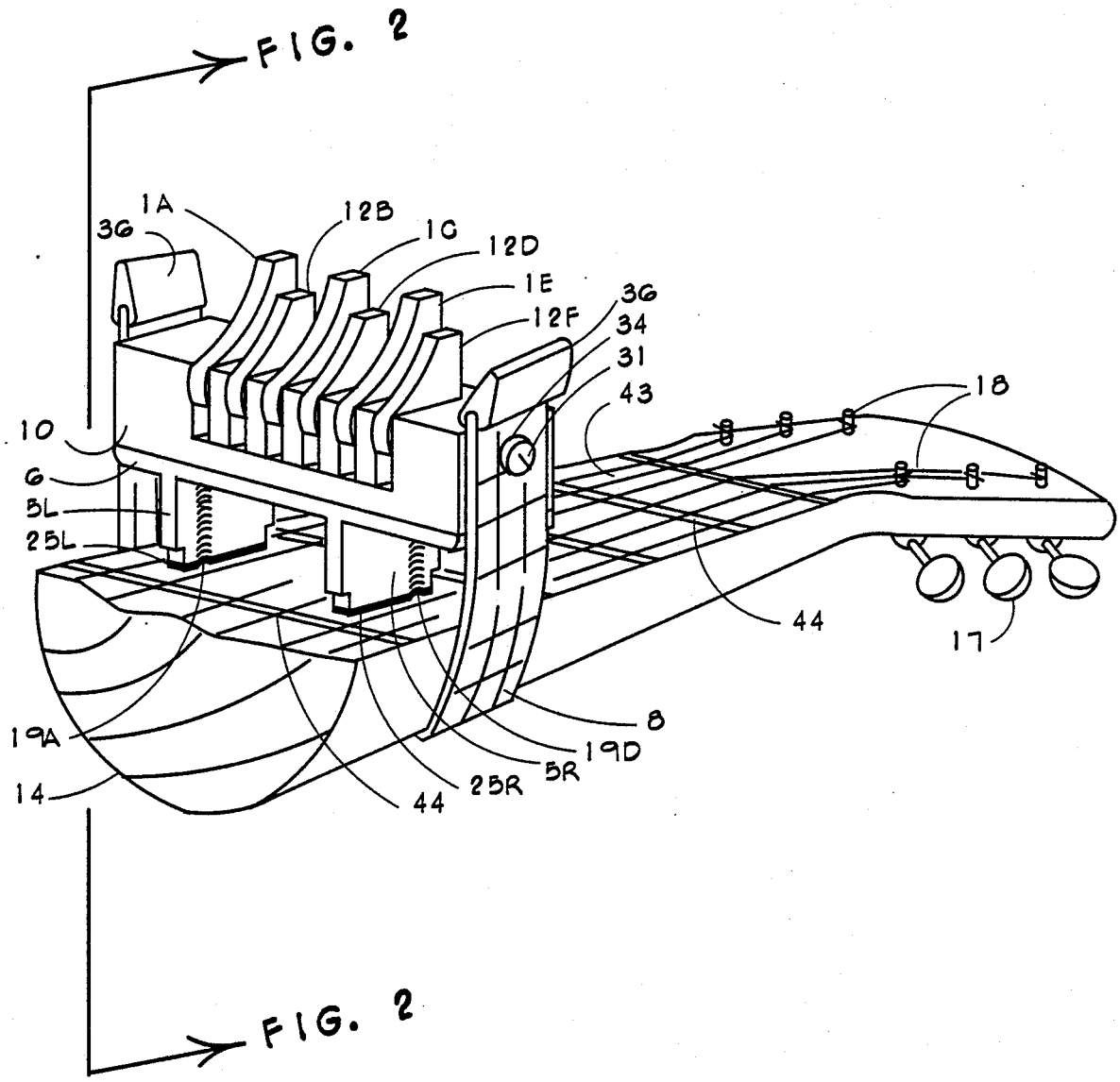
FIG. 1 is a perspective view of a portion of the neck of a guitar and its fingerboard showing the CAPOTASTO in place with all 6 of its fretters (plungers) in the up or disengaged positions.
Figure 2:
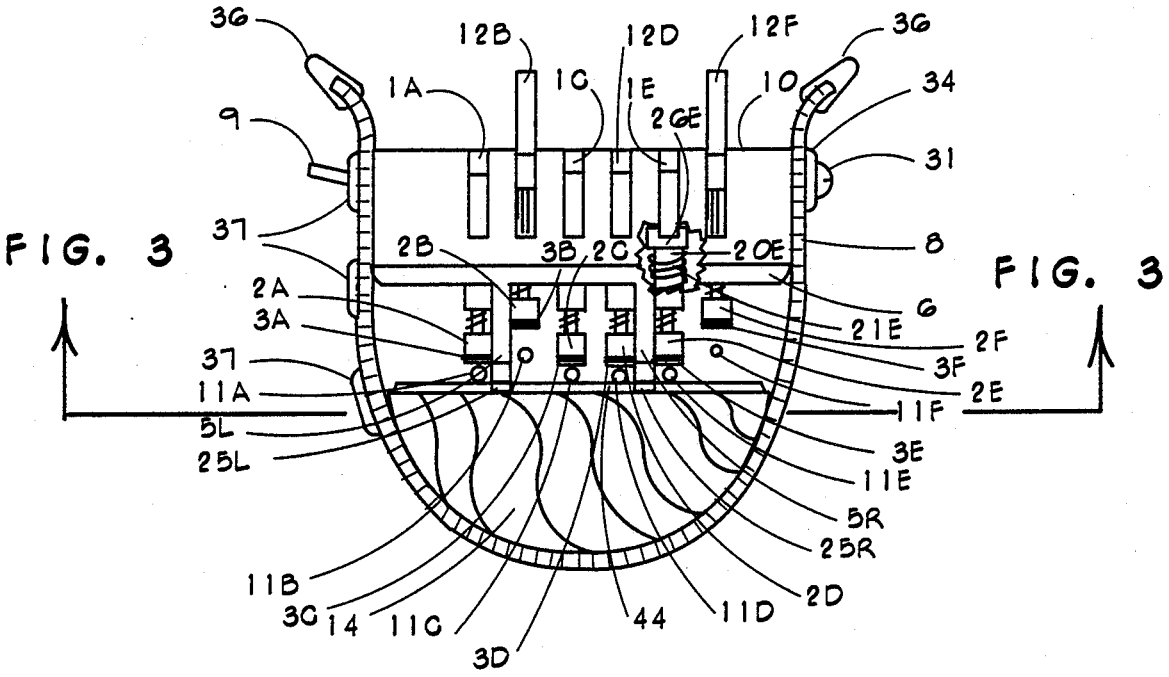
FIG. 2 is a partial cross-sectional view of the CAPOTASTO taken along the line 2—2 in FIG. 1.
Figure 3:
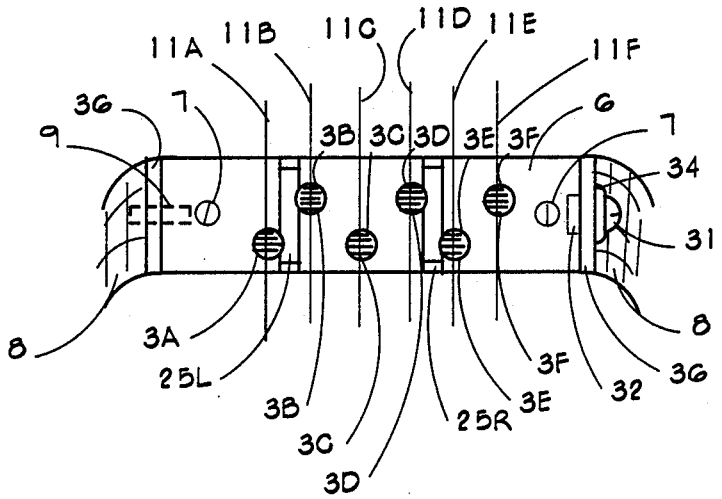
FIG. 3 is a bottom view of the CAPOTASTO in FIG. 2 taken along the line 3—3.

Referring to FIG. 1, FIG. 2 and FIG. 3, there is shown a portion of a guitar Neck 14, having the usual six Strings 11A through 11F. Tensioning Pegs 18 are used to adjust the pitch of the strings by use of the Knobs 17. Frets 44 are proportionately located along the Fretboard 43 (containing approximately 18 Frets on the typical acoustic guitar) transverse to the large String 11A through the smallest String 11F (diminishing from bass to treble) to enable greater changes in pitch by depressing the strings onto the different Frets 44.

Figure 4:
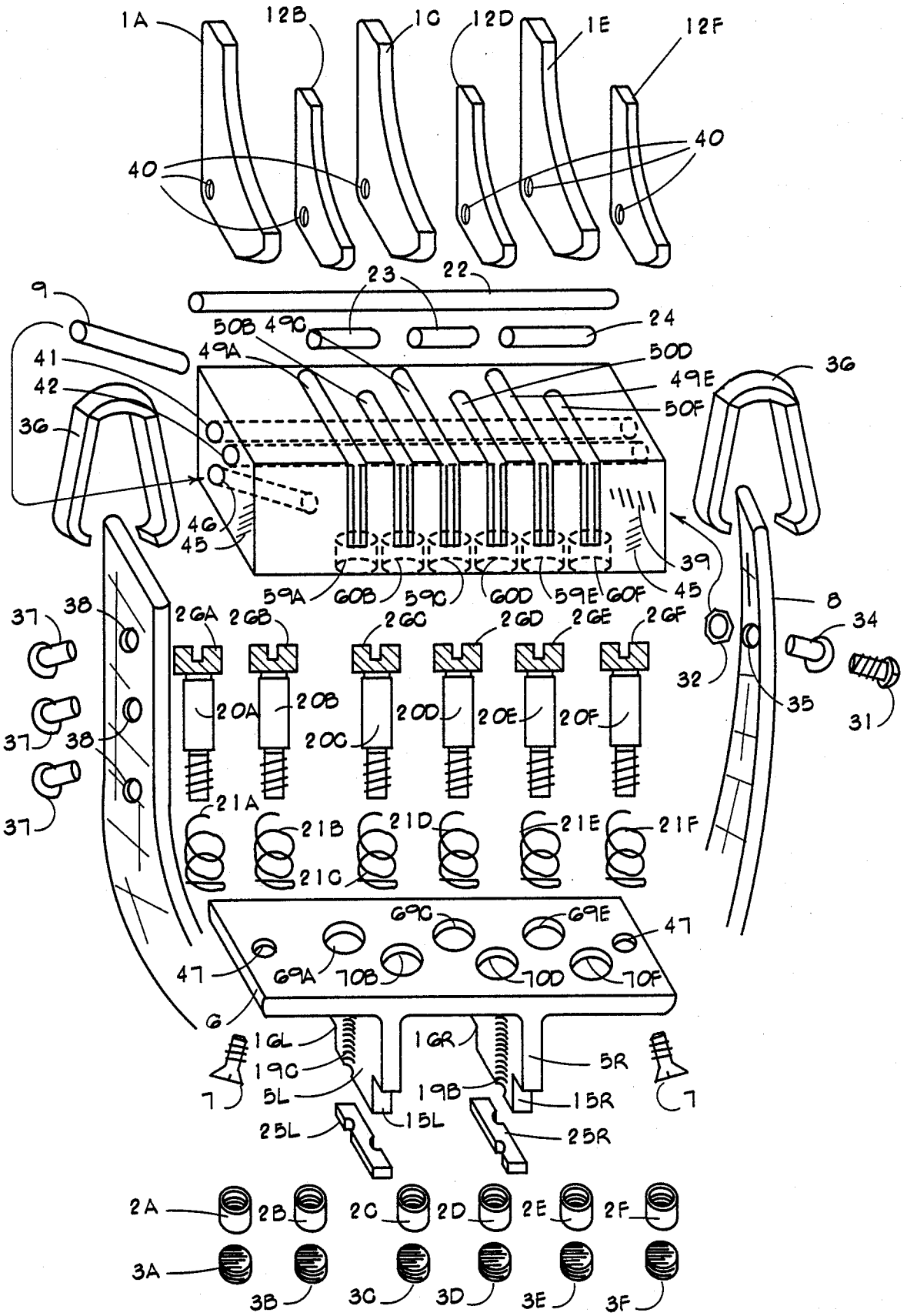
FIG. 4 is an exploded view of the CAPOTASTO.

The CAPOTASTO is displayed mounted in FIG. 2 and in the exploded parts drawing shown in FIG. 4. The Mounting Block 10 is the nucleus of the CAPOTASTO's operating system; this Block 10 supports and makes functional the other parts of the system. It contains six vertical slots which are milled at the top and the front with alternately staggered slots 49A, 50B, 49C, 50D, 49E, 50F. These slots are essentially milled out square to accept the six Cam Levers 1A, 12B, 1C, 12D, 1E, 12F each with Mounting Hole 40 drilled in its foot. The CAPOTASTO unit allows for the internal maneuverability and push/pull actions on the top of the Block 10 for the Cam Levers Al, 12B, 1C, 12D, 1E, 12F. The unit also contains six vertical Plungers 20A, 20B, 20C, 20D, 20E, 20F (each containing slotted heads 26A, 26B, 26C, 26D, 26E, 26F for locking and adjusting purposes) and conveying Holes 59A, 60B, 59C, 60D, 59E, 60F. These are drilled through the base, vertically from the bottom, to accept the aforementioned Plungers along with their ancillary attachments consisting of Springs 21A, 21B, 21C, 21D, 21E, 21F, adjustable nylon Shaft Extensions (threaded) 2A, 2B, 2C, 2D, 2E, 2F, hard rubber Pads 3A, 3B, 3C, 3D, 3E, 3F (these string pressure tips are made of neoprene with an elasticity measurement of approximately 60 Durometers, and are attached to the closed end of the aforementioned shaft extensions with contact cement). The Mounting Block 10 also contains two internal horizontally drilled tubular Holes 41 and 42 for the Cam Levers lA, 12B, 1C, 12D, 1E, 12F's Securing Rods 22, 23, 24, one angularly drilled Hole 46 for installing the resilient mounting Strap 8's fastening Pin 9, one horizontal threaded screw Hole 39 for attaching the Strap 8 fixed round-headed slotted Screw 31, Lock Nut 32 and Rivet 34 (passing through Strap 8's Hole 35) sub-assembly, and two vertically drilled and threaded machine screw Holes 45 on the bottom of the Block. These Holes 45 are at opposite ends of the bottom of Mounting Block 10 and facilitate attaching Plunger Plate 6. The Strap 8 sub-assembly also contains 3 Holes 38 to allow input of three Rivets 37 which provide fine adjustments on the necks of various sized musical instruments. Two metal Clips 36 are clamped on the distal ends of Strap 8 for ease of grasping and pulling as well as preventing fraying of Strap 8.

This Mounting Block 10 can be made from hardwoods, ivory, injected plastic materials, and various dense metals including precious metals. Additionally, in lieu of using the resilient Strap 8 to attach it to almost any type of stringed instrument, one can make onto the CAPOTASTO other types metal/plastic/etc. thumb screw adjustable or spring loaded clamps.

The Plunger Base Plate 6 is stamped out of a dense material, such as aluminum or stainless steel (all components of this CAPOTASTO must be made from compatible substances in order to minimize electrolysis and galvanical reactions which eventually would make this device more difficult to operate). It is drilled with a row of Holes 69A, 69C, 69E and a staggered row, as seen in FIG. 4, of Holes 70B, 70D, 70E to allow the Plungers 20A through 20F, Shaft Extensions 2A through 2F and Pads 3A through 3F to egress from inside of the Mounting Block 10. These Holes 69A, 69C, 69E, 70B, 70D, 70F must be drilled or stamped carefully with each pair of proximal holes located to compensate for the gradually increasing/decreasing change in strings' separation as the CAPOTASTO is moved longitudinally along the neck of a musical instrument. Also drilled in the Plunger Base Plate 6 are two counter-sunk Holes 47 located at opposite ends. These accommodate the two bevel-headed Allen-wrench slotted type Screws 7 which are used to attach the Plate 6 to the Block 10. Additionally, two support and balancing legs which we designate as Stabilizers 5L left and 5R right are milled, welded or molded onto the bottom of the Plunger Base Plate 6. They maintain proper horizontal separation and vertical alignment to the Fretboard 43 as well as prevent undesirable yawing and skewing. Each Stabilizer 5L and 5R has a thin layer of rubber-like Pad 25L, 25R glued on with contact cement, on the distal end of its leg to inhibit sliding, marring and scratching on the Fretboard 43. Notches 15L and 16L on Stabilizer 5L and Notches 15R and 16R on Stabilizer 5R enable the CAPOTASTO to be positioned low on the Fretboard 43 where the Frets 44 are located close together. Groove 19A provides correct spacing path for Pad 3B onto String 11B. Groove 19B provides correct spacing path for Pad 3D onto String 11D. Groove 19C provides correct spacing path for Pad 3A onto String 11A. Groove 19D provides correct spacing path for Pad 3E onto String 11E.

To mute, or inhibit a string on a musical instrument with the CAPOTASTO, a toggle lever is used, such as Cam Lever 1A. It is the same height as Cam Levers 1C and 1E and taller than Cam Levers 12B, 12D, 12F. These differences provide the musician good visual references when setting the cams to the desired positions and adequate finger clearances. When a Cam Lever, such as 1A, is pulled forward and downward, it slides in the locking Slot 26A in the top of the head of Plunger Screw 20A. The Plunger Screw 20A presses down upon its stainless steel compression Spring 21A, which exerts approximately 2 psi resistance. This entire sub-assembly is also compromised of one nylon dowel (drilled and threaded inside one end) Plunger Bushing Extension 2A with a Plunger Pressure Pad 3A glued upon its closed end. This Pad 3A presses String 11A against the chosen Fret 44. To disenable this muted string, the musician can quickly and conveniently release this entire sub-assembly by moving Cam Lever 1A in an upward and reverse direction. When String 11A has been either engaged or disengaged, the other strings can be selectively engaged by the player.

Our improved CAPOTASTO has outstanding advantages over its predecessors. Individual adjusting pressure plunger pads can be appropriately adjusted to compensate for various diameter strings on a great number of different stringed instruments, as well as different lateral curvatures on some instruments. Once this unit has been set up for a particular stringed instrument, it can be removed and reattached by means of its resilient strap without requiring readjustment of its plunger pads.

While this invention has been shown in only one of its forms, it should be appreciated by those skilled in the art that it is not thus limited, but is susceptible to various changes and modifications without departing from the spirit thereof.

We claim:

1. A variable chord-forming capotasto, comprising:

a body;

means for releasably mounting said body to the neck of a stringed musical instrument; and a plurality of string stopping means, one for each string on said instrument, said plurality of string stopping means being oriented on said body to engage the strings adjacent a selected fret, each of said string stopping means comprising a string engaging means individually actuated to depress the respective string into contact with said adjacent fret, and a cam lever pivoted on said body to selectively actuate said string engaging means and to lock said string engaging means in the actuated state.

2. The capotasto of claim 1 wherein each of said string engaging means consists of a plunger.

3. The capotasto of claim 2 wherein said plunger has an adjustable extension thereon to selectively vary the effective length of said plunger..

4. The capotasto of claim 3 wherein said extension has a padded tip thereon for engaging said string.

5. The capotasto of claim 1 wherein said releasable mounting means consists of a resilient strap having one end fixed to said body and the other end releasably attached to a pin extending from said body by hooking one of a plurality of eyelets on said pin.

6. The capotasto of claim 5 wherein said strap has at least one clip attached to an end thereof to aid in grasping and pulling said strap.

7. The capotasto of claim 1 wherein said body includes a pair of stabilizer legs depending therefrom to space said body from said neck.

8. The capotasto of claim 7 wherein each of said legs is notched to permit a fret to fit therein.

9. The capotasto of claim 1 wherein alternate ones of said cam levers have actuating arms of differing length than the adjacent levers to provide visual and tactile reference of said cam levers.

* * * * *